United States Patent [19]

Archer et al.

[11] Patent Number: 4,845,507

[45] Date of Patent: Jul. 4, 1989

[54] MODULAR MULTIBEAM RADIO FREQUENCY ARRAY ANTENNA SYSTEM

[75] Inventors: Donald H. Archer; Wilbur H. Thies, Jr., both of Santa Barbara, Calif.

[73] Assignee: Raytheon Company, Lexington, Mass.

[21] Appl. No.: 82,705

[22] Filed: Aug. 7, 1987

[51] Int. Cl.[4] ..... H01Q 3/46; H01Q 19/06

[52] U.S. Cl. ..... 343/754; 343/853; 342/374

[58] Field of Search ..... 343/753, 754, 853; 342/368, 371–373, 374

[56] References Cited

U.S. PATENT DOCUMENTS

| | | | |
|---|---|---|---|
| 4,107,692 | 8/1978 | Hutcheon et al. | 343/754 |
| 4,121,221 | 10/1978 | Meadows | 343/853 |
| 4,507,612 | 3/1985 | Rothenberg et al. | 343/754 |
| 4,612,548 | 9/1986 | Beltran | 343/754 |

*Primary Examiner*—Rolf Hille
*Assistant Examiner*—Michael C. Wimer
*Attorney, Agent, or Firm*—Edmund J. Walsh; Richard M. Sharkansky

[57] ABSTRACT

A radio frequency antenna system comprising a plurality of antenna elements arranged in an array, such array comprising a pair of subarrays of antenna elements coupled to a pair of electromagnetic lenses. Each lens includes a plurality of array ports, the plurality of array ports of the first lens being coupled to the antenna elements of a first one of the pair of subarrays, and the plurality of array ports of the second lens being coupled to the antenna elements of a second one of the pair of subarrays. The first lens further comprises a first set of beam ports, and the second lens further comprises a second set of beam ports, the first and second sets of beam ports being arranged to form corresponding first and second sets of interleaved beams of radio frequency energy. The antenna array combines the interleaved first and second sets of beams to form a plurality of beams of radio frequency energy, each one of the plurality of beams being a composite beam of adjacent beams of the interleaved first and second sets of beams. With such arrangement, a set of 2N−1 composite beams may be formed with only N beam ports on each lens. Further, the high-frequency crossovers between adjacent composite beams may be maintained substantially at −3 dB, thereby providing substantially uniform coverage over the scan sector of the antenna system. Also, since 2N−1 composite beams are formed from lenses having only N beam ports, the switching complexity between a transmitter or receiver and each lens is reduced.

15 Claims, 5 Drawing Sheets

MODULAR MULTIBEAM RADIO FREQUENCY ARRAY ANTENNA SYSTEM

BACKGROUND OF THE INVENTION

This invention relates generally to radio frequency array antenna systems and more particularly to radio frequency array antenna systems adapted to form a plurality of distinct beams of radio frequency energy.

As is known, a radio frequency array antenna system may be arranged to produce a plurality of distinct, spaced beams of radio frequency energy. Typically, each one of the plurality of beams has the gain and beamwidth of the entire antenna array and a different scan angle with respect to the boresight axis of the array. As is also known, such plurality of spaced beams may be produced by coupling each array antenna element through a different partially constrained electrical path to a corresponding plurality of beam ports, the partially constrained electrical paths comprising an electro-magnetic lens which equalizes the time delay of the electro-magnetic energy between the beam ports and all points on corresponding planar wavefronts of either transmitted or received energy. One such antenna system is described in U.S. Pat. No. 3,761,936, entitled, "MultiBeam Array Antenna", inventors D. H. Archer et al, issued Sept. 25, 1973, and assigned to the present assignee.

While such an array antenna system has proved satisfactory in some applications, it is often desirable that an array antenna having relatively high effective radiated power (ERP) for transmitted radio frequency energy and correspondingly high sensitivity to received energy. One conventional way of achieving such high ERP and sensitivity is to increase the size of the array by adding antenna elements thereto, thereby enlarging the antenna aperture and increasing the gain of the array. This typically requires the electromagnetic lens feeding the array to be enlarged to accommodate the additional antenna elements. As discussed in the above-referenced patent, the electromagnetic lens is typically fabricated as a stripline, parallel plate lens, with a printed circuit defining the partially constrained electrical paths being formed on one side of a dielectric substrate and a metallic ground plane being formed on the other side thereof. A second dielectric slab is disposed over the printed circuit with a second metallic ground plane covering the exposed side of such dielectric slab. The printed circuit is typically relatively thin due to the high frequencies of the transmitted and received radio frequency energy. Thus, the larger required lens is fragile and difficult to manufacture. Also, each dielectric slab of such a large lens must often comprise several sections of dielectric material, the performance of such "sectioned" lens being degraded over that of a lens fabricated from a single section of dielectric material. In applications wherein the array antenna is disposed in a housing for mobile use, increasing the size of the electromagnetic lens necessitates a larger housing, which may be unacceptable where the size and weight of the system must be kept small. The size of the electromagnetic lens could be reduced by increasing the dielectric constant of the dielectric material, but such lens would be difficult to fabricate because the array ports thereof would be disposed closer together by decreasing the size of the lens.

One possible solution to the problems encountered with a single large lens would be to implement the lens as a pair of modular, identically constructed lenses, each lens being one-half the size of the single large lens. The array ports of each lens would feed one-half of the array of antenna elements. The pair of lenses and sub-arrays of antenna elements thus would form corresponding pairs of overlaying beams of energy associated with each beam port thereof. Each pair of overlaying beams produced by the two halves (i.e., subarrays) of the array would spatially combine to produce a composite beam having a width one-half that of each one of the pair of constituent beams. As is known, at the upper end of the operating frequency band of the array antenna, it is desired that adjacent composite beams cross over one another at the −3dB points thereof to ensure that the sector (e.g. azimuth) scanned by the antenna is covered relatively uniformly by the composite beams produced thereby. However, the half-width composite beams which would be produced by the modular pair of identical lenses would have crossovers at −12dB, thereby providing "holes" in the coverage provided by the array antenna. Additional beam positions could be provided to re-establish the desired −3dB crossovers, but such would require doubling the number of beams, thereby necessitating twice as many beam ports on each lens. Also, since the beams produced by the array conventionally are steered across the azimuth of the array by switches which sequentially switch each lens beam port, doubling the number of beam ports on each lens would require doubling the number of throws of each azimuth beam-steering switch, thus increasing the complexity of the antenna system.

SUMMARY OF THE INVENTION

In accordance with the present invention, a radio frequency array antenna system is provided comprising an array antenna comprising a plurality of antenna elements and a plurality of electromagnetic lenses. Each lens includes a set of array ports coupled to corresponding ones of the plurality of antenna elements. Each lens further comprises a set of beam ports having locations with a predetermined, nominal spacing therebetween, the locations of corresponding beam ports of the plurality of lenses being skewed with respect to each other by substantially the nominal spacing multiplied by the reciprocal of the plurality of lenses. With such arrangement, corresponding beam ports of the plurality of lenses are arranged to form a corresponding plurality of beams of radio frequency energy having patterns projected in different directions, the antenna array combining the plurality of beams to form a composite beam of radio frequency energy having a pattern projecting in a direction intermediate the directions of the patterns of the plurality of beams. Hence, a relatively large array of antenna elements may be implemented as a plurality of subarrays of antenna elements driven with a plurality of modular lenses, rather than with a single, large lens, thereby maintaining the overall size of the system small while increasing the gain and decreasing the beamwidth of the antenna system. The smaller, modular lenses are easier to manufacture, less fragile, and exhibit increased performance over a single, large lens.

In a preferred embodiment of the present invention, a radio frequency antenna system is provided comprising an antenna comprising a plurality of antenna elements arranged in an array, such array comprising a pair of subarrays of antenna elements coupled to a pair of electromagnetic lenses. Each one of said pair of lenses include a plurality of array ports, the plurality of array ports of a first one of the pair of lenses being coupled to the antenna elements of a first one of the pair of subarrays, and the plurality of array ports of a second one of the pair of lenses being coupled to the antenna elements of a second one of the pair of subarrays. The first one of the pair of lenses further comprises a first set of beam ports, and the second one of the pair of lenses further comprises a second set of beam ports, the first and second sets of beam ports being arranged to form corresponding first and second sets of beams of radio frequency energy, the first set of beams being interleaved with the second set of beams. The antenna array combines the interleaved first and second sets of beams to form a plurality of beams of radio frequency energy, each one of the plurality of beams being a composite beam of adjacent beams of the interleaved first and second sets of beams. With such arrangement, a set of 2N−1 composite beams may be formed with only N beam ports on each lens. Further, the high-frequency crossovers between adjacent composite beams may be maintained substantially at −3dB, thereby providing substantially uniform coverage over the scan sector of the antenna system. Also, since 2N−1 composite beams are formed from lenses having only N beam ports, the switching complexity between a transmitter or receiver and each lens is reduced.

BRIEF DESCRIPTION OF THE DRAWINGS

The foregoing features of the present invention and the advantages thereof may be fully appreciated from the following detailed description read in conjunction with the accompanying drawings wherein.

DESCRIPTION OF THE PREFERRED EMBODIMENTS

Figure 1:
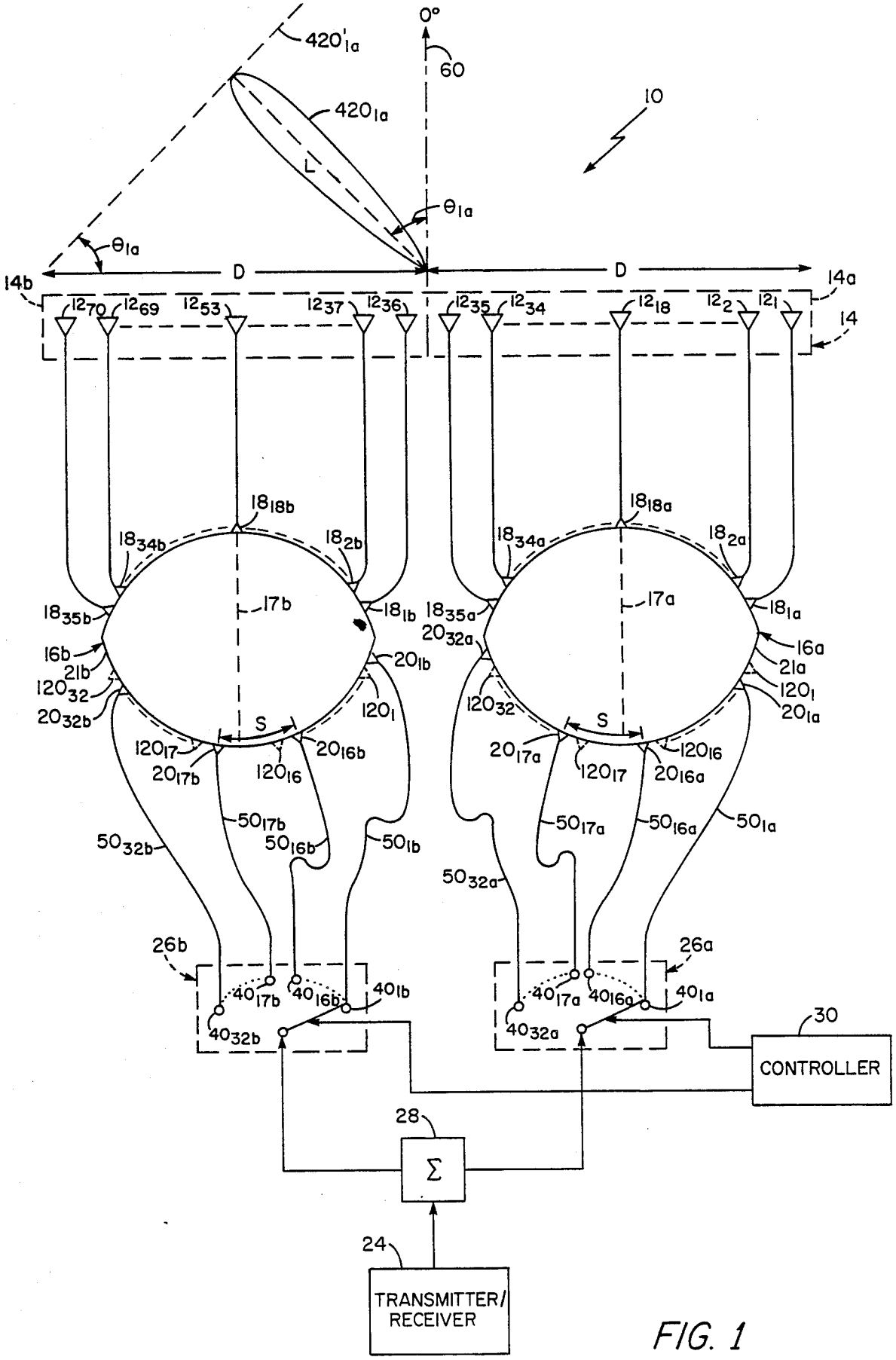
FIG. 1 is a schematic diagram of an array antenna system according to the present invention.

Referring to FIG. 1, a multibeam array antenna system 10 is schematically shown to comprise a plurality, here seventy, of antenna elements $\mathbf{12}_1$–$\mathbf{12}_{70}$ arranged in an array 14 and coupled as shown to a plurality, here two, of radio frequency (RF) beam forming elements 16*a*, 16*b*. Beam forming elements 16*a*, 16*b* here are implemented as electromagnetic lenses, each similar in construction to the lens described in the above-referenced U.S. Pat. No. 3,761,936. Here, each lens 16*a*, 16*b* includes a plurality, here 32, of beam ports $\mathbf{20}_{1a}$–$\mathbf{20}_{32a}$, $\mathbf{20}_{1b}$–$\mathbf{20}_{32b}$, respectively, arranged in a manner described in detail below and coupled to transmitter/receiver 24 through RF switches 26*a*, 26*b* and power divider/combiner 28, as shown. Briefly, however, beam ports $\mathbf{20}_{1a}$–$\mathbf{20}_{32a}$ are disposed on lens 16*a* with a predetermined, nominal spacing S therebetween, and beam ports $\mathbf{20}_{1b}$–$\mathbf{20}_{32b}$ are disposed on lens 16*b* with a predetermined, nominal spacing S therebetween, with corresponding beam ports of lenses 16*a*, 16*b* (i.e., beam ports $\mathbf{20}_{1a}$, $\mathbf{20}_{1b}$ . . . $\mathbf{20}_{32a}$, $\mathbf{20}_{32b}$) having locations skewed with respect to each other by substantially the nominal spacing S multiplied by the reciprocal of the number of lenses of antenna system 10 (here, two). With such arrangement, the corresponding pairs of beam ports of lenses 16*a*, 16*b* form corresponding pairs of beams of radio frequency energy having patterns skewed from each other by a predetermined amount, such pairs of beams being combined by the entire array 14 of antenna elements $\mathbf{12}_1$–$\mathbf{12}_{70}$ to form a set of composite beams of radio frequency energy having patterns projecting in directions intermediate the directions of the skewed pairs of beams formed by individual RF lenses 16*a*, 16*b*. Thus, a relatively large array 14 of antenna elements $\mathbf{12}_1$–$\mathbf{12}_{70}$ may be coupled to a plurality of relatively small modular beam forming lenses 16*a*, 16*b*, rather than to a single, relatively large lens, thereby allowing antenna system 10 to include additional antenna elements (thus increasing the gain thereof and decreasing the beamwidth of the composite beams formed thereby) while keeping the overall size of lenses 16*a*, 16*b* relatively small. Further, the plurality of relatively small, modular lenses are less fragile and easier to fabricate than a single, relatively large lens. Moreover, the dielectric layers of the modular lenses may be manufactured from a single block of dielectric material, rather than from a mosaic of material blocks, as is often required with a large lens. Additionally, the skewed arrangement of corresponding beam ports $\mathbf{20}_{1a}$, $\mathbf{20}_{1b}$ . . . $\mathbf{20}_{32a}$, $\mathbf{20}_{32b}$ provides equal high-frequency crossovers between adjacent composite beams which are substantially at −3dB with a reduced number of beam ports on each lens 16*a*, 16*b* than was heretofore possible. Thus, array antenna system 10 produces composite beams which do not have "deep" crossovers (such as −12dB), thereby avoiding the presence of "holes" in the coverage thereof without requiring complex beam port arrangements on lenses 16*a*, 16*b*.

More specifically, array 14 of antenna elements $\mathbf{12}_1$–$\mathbf{12}_{70}$ here is arranged in a plurality, here two, of subarrays 14*a*, 14*b*, with subarray 14*a* comprising elements $\mathbf{12}_1$–$\mathbf{12}_{35}$ and being coupled to lens 16*a*, and subarray 14*b* comprising antenna elements $\mathbf{12}_{36}$–$\mathbf{12}_{70}$ coupled to lens 16*b*, as shown. It is noted here that seventy antenna elements are discussed for illustrative purposes only; array 14 may comprise more or less radiating elements. Subarrays 14*a*, 14*b* are here disposed symmetrically about a boresight axis 60 of array 14, here with antenna elements $\mathbf{12}_1$–$\mathbf{12}_{35}$ disposed to the right of boresight axis 60, and elements $\mathbf{12}_{36}$–$\mathbf{12}_{70}$ disposed to the left of axis 60. Each subarray 14*a*, 14*b* has a length D, with the length of array 14 thus being 2D. Antenna elements $\mathbf{12}_1$–$\mathbf{12}_{35}$ are coupled to a corresponding set of a plurality, here 35, of array ports $\mathbf{18}_{1a}$–$\mathbf{18}_{35a}$ on lens 16*a* through a set of transmission lines, here comprising coaxial cables, not numbered. Likewise, antenna elements $\mathbf{12}_{36}$–$\mathbf{12}_{70}$ are coupled through a set of transmission lines, such as coaxial cables (not numbered) to a corresponding set of a plurality of array ports $\mathbf{18}_{1b}$–$\mathbf{18}_{35b}$ on lens 16*b*. Each array port $\mathbf{18}_{1a}$–$\mathbf{18}_{35a}$, $\mathbf{18}_{1b}$–$\mathbf{18}_{35b}$ comprises an impedance matching section (not numbered) for matching the impedance of lenses 16*a*, 16*b* to that of the coaxial cables coupling such array ports to respective antenna elements $\mathbf{12}_1$–$\mathbf{12}_{70}$. It is noted parenthetically that array antenna system 10 may be either a transmitting or receiving arrangement due to the principle of antenna reciprocity. In the former case, which will be assumed for the purposes of the present discussion, a plurality of amplifiers, such as travelling-wave-tube (TWT) amplifiers, are typically disposed in the cables coupling the array ports of lenses 16a, 16b to array 14, such amplifiers being omitted from FIG. 1 for simplicity.

As stated, array antenna system 10 here is a transmitting system. Thus, here transmitter/receiver 24 comprises a conventional RF signal generator (not shown) such as that discussed in U.S. Pat. No. 3,715,749, entitled, "Multi-Beam Radio Frequency System", issued Feb. 6, 1973 and assigned to the present assignee. Such signal generator 24 produces an RF signal over a predetermined frequency band $f_L$ to $f_H$, such signal being equally divided by power divider/combiner 28 and coupled in-phase to RF switches 26a, 26b. Switches 26a, 26b here are conventional single-pole-32-throw (SP32T) radio frequency switches actuated in a manner to be described by control signals from controller 30. The contacts $\mathbf{40}_{1a}$–$\mathbf{40}_{32a}$ of SP32T switch 26a are coupled through transmission lines $\mathbf{50}_{1a}$–$\mathbf{50}_{32a}$ (here comprising coaxial cables) to corresponding beam ports $\mathbf{20}_{1a}$–$\mathbf{20}_{32a}$, respectively, of lens 16a. Likewise, contacts $\mathbf{40}_{1b}$–$\mathbf{40}_{32b}$ of switch 26b are coupled to corresponding beam ports $\mathbf{20}_{1b}$–$\mathbf{20}_{32b}$, respectively, of lens 16b via transmission lines $\mathbf{50}_{1b}$–$\mathbf{50}_{32b}$ (here comprising coaxial cables). It may thus be appreciated that, depending on the positions of SP32T switches 26a, 26b as determined by controller 30, the output of transmitter/receiver 24 is simultaneously applied to a selected one of beam ports $\mathbf{20}_{1a}$–$\mathbf{20}_{32a}$ of lens 16a and to a selected one of beam ports $\mathbf{20}_{1b}$–$\mathbf{20}_{32b}$ of lens 16b.

Lenses 16a, 16b here are symmetrically disposed about axes 17a, 17b, respectively, which are parallel to each other and to boresight axis 60. Beam ports $\mathbf{20}_{1a}$–$\mathbf{20}_{32a}$ are disposed on a peripheral surface 21a of lens 16a which describes the arc of a circle conventionally known as the "focal arc" or "arc of best focus" of such lens 16a. Likewise, beam ports $\mathbf{20}_{1b}$–$\mathbf{20}_{32b}$ are arranged on peripheral surface 21b of lens 16b which describes the arc of best focus of such lens 16b. Beam ports $\mathbf{20}_{1a}$–$\mathbf{20}_{32a}$, $\mathbf{20}_{1b}$–$\mathbf{20}_{32b}$ comprise impedance matching sections (not numbered) for matching the impedances of lenses 16a, 16b to coaxial cables $\mathbf{50}_{1a}$–$\mathbf{50}_{32a}$, $\mathbf{50}_{1b}$–$\mathbf{50}_{32b}$, respectively. Lens 16a here forms, with subarray 14a of antenna elements $\mathbf{12}_1$–$\mathbf{12}_{35}$, 32 separate beams of radio frequency energy, one each associated with beam ports $\mathbf{20}_{1a}$–$\mathbf{20}_{32a}$. Likewise, lens 16b, with subarray 14b of antenna elements $\mathbf{12}_{36}$–$\mathbf{12}_{70}$, here forms 32 distinct beams, one each associated with beam ports $\mathbf{20}_{1b}$–$\mathbf{20}_{32b}$. As known and as discussed in the above-referenced U.S. Pat. No. 3,761,936, each one of the beams formed by lenses 16a, 16b and subarrays 14a, 14b has associated therewith a planar wavefront of energy disposed perpendicularly to the beam, that is, orthogonally to the angle $\theta$ (with respect to boresight 60) at which the beam pattern is projected by arrays 14a, 14b. Lens 16a, antenna elements $\mathbf{12}_1$–$\mathbf{12}_{35}$ and the interconnecting cables are arranged so that the electrical path lengths from any selected one of beam ports $\mathbf{20}_{1a}$–$\mathbf{20}_{32a}$ to all points along the planar wavefront of the beam of energy associated with such selected one of beam ports $\mathbf{20}_{1a}$–$\mathbf{20}_{32a}$ are approximately equal. For example, the lengths of the paths from beam port $\mathbf{20}_{1a}$ to the planar wavefront of the beam of energy associated with beam port $\mathbf{20}_{1a}$ are approximately the same for energy emanating from every one of antenna elements $\mathbf{12}_1$–$\mathbf{12}_{35}$ of subarray 14a. Likewise, lens 16b, antenna elements $\mathbf{12}_{36}$–$\mathbf{12}_{70}$ and the interconnecting cables are arranged so that the electrical path lengths from any given one of beam ports $\mathbf{20}_{1b}$–$\mathbf{20}_{32b}$ to all points along the planar wavefront of the beam associated with such selected one of beam ports $\mathbf{20}_{1b}$–$\mathbf{20}_{32b}$ are approximately equal. For example, the lengths of the paths from beam port $\mathbf{20}_{1b}$ to the planar wavefront of energy of the beam associated therewith are approximately the same for energy radiating from every one of antenna elements $\mathbf{12}_{36}$–$\mathbf{12}_{70}$.

For purposes of illustrating the invention, each lens 16a, 16b is shown in FIG. 1 to also have a plurality, here 32, of nominal beam port locations $\mathbf{120}_1$–$\mathbf{120}_{32}$ disposed at identical positions on surfaces 21a, 21b, respectively. For example, nominal beam port location $\mathbf{120}_1$ is at the same point on surface 21a of lens 16a as such nominal beam port location $\mathbf{120}_1$ is on surface 21b lens 16b. To put it another way, if lens 16b is placed on top of lens 16a, and axes of symmetry 17a, 17b aligned, corresponding nominal beam port locations $\mathbf{120}_1$–$\mathbf{120}_{32}$ on surfaces 21a, 21b would overlay each other. However, with the present invention and for purposes discussed in detail hereinafter, beam ports $\mathbf{20}_{1a}$–$\mathbf{20}_{32a}$, $\mathbf{20}_{1b}$–$\mathbf{20}_{32b}$ are offset from nominal beam port locations $\mathbf{120}_1$–$\mathbf{120}_{32}$ in opposite directions by a predetermined amount in sin $\theta$ space. Thus, as shown in FIG. 1, beam ports $\mathbf{20}_{1a}$–$\mathbf{20}_{32a}$ here are offset clockwise on surface 21a by a predetermined amount from nominal locations $\mathbf{120}_1$–$\mathbf{120}_{32}$, while beam ports $\mathbf{20}_{1b}$–$\mathbf{20}_{32b}$ here are offset counterclockwise along surface 21b by a predetermined amount from nominal locations $\mathbf{120}_1$–$\mathbf{120}_{32}$. Thus, corresponding beam ports of lenses 16a, 16b (that is, beam ports $\mathbf{20}_{1a}$, $\mathbf{20}_{1b}$ . . . $\mathbf{20}_{32a}$, $\mathbf{20}_{32b}$) are "skewed" from each other by a predetermined amount in sin $\theta$ space, resulting in corresponding beams formed by such lenses 16a, 16b also being skewed from each other by a predetermined amount in sin $\theta$ space. To put it another way, the 32 beams formed by lens 16a and subarray 14a have patterns skewed from the patterns of corresponding ones of the 32 beams formed by lens 16b and subarray 14b, with the beams associated with lens 16a being interleaved with the beams from lens 16b. Such interleaved beams are combined by the entire array 14 of antenna elements $\mathbf{12}_1$–$\mathbf{12}_{70}$ to here form 63 discrete, composite beams having patterns projected in directions intermediate to the patterns of adjacent ones of the interleaved beams. As will become clear, at high-frequency ($f_H$) adjacent composite beams have crossovers substantially at −3dB, thereby providing complete and substantially uniform radar coverage over the operating sector (e.g. azimuth) of the array antenna system 10.

The positions of nominal beam port locations $\mathbf{120}_1$–$\mathbf{120}_{32}$ are determined by the extent, in sin $\theta$ space, of the desired scan sector (e.g. azimuth) of antenna system 10 and the number of beams produced by each lens 16a, 16b (i.e. here 32). Assuming, for purposes of illustration, that the desired scan sector, in $\theta$ space, of antenna system 10 is from −45° to +45° with respect to boresight axis 60, it follows that the total scan sector is 1.414 in sine space (sin (−45°) to sin +45°). Since each lens 16a, 16b produces 32 beams with 32 beam ports, it also follows that there are 31 spaces between the 32 beams and 31 spaces between the 32 beam ports. As is known, beam ports should be equally spaced in sin $\theta$ space in order to produce corresponding beams which are also equally spaced in sin $\theta$ space, thereby providing equal high-frequency ($f_H$) crossovers for all of such beams, which is desirable for uniform coverage. Thus, here nominal beam port locations $\mathbf{120}_1$–$\mathbf{120}_{32}$ are equally spaced at a spacing, S, of:

$$S=1.414/31=0.0456 \quad (1)$$

along surfaces 21*a*, 21*b*. Assigning axes of symmetry 17*a*, 17*b* as "0" reference points, it follows that nominal beam port locations $\mathbf{120}_{16}$, $\mathbf{120}_{17}$ are disposed at ±0.0228 (i.e. 0.0228 to the right and left, respectively, of axes 17*a*, 17*b*), with the remaining beam port locations $\mathbf{120}_{15}$–$\mathbf{120}_{1}$, $\mathbf{120}_{18}$–$\mathbf{120}_{32}$ being positioned at intervals of ±0.0456, respectively, therefrom. Since nominal beam port locations $\mathbf{120}_{1}$–$\mathbf{120}_{32}$ are at the same points on lenses 16*a*, 16*b*, it is seen that if beam ports $\mathbf{20}_{1a}$–$\mathbf{20}_{32a}$, $\mathbf{20}_{1b}$–$\mathbf{20}_{32b}$ are positioned at nominal beam port locations $\mathbf{120}_{1}$–$\mathbf{120}_{32}$, lenses 16*a*, 16*b* and subarrays 14*a*, 14*b*, respectively, would form 32 pairs of overlaying beams; that is, each pair of the 32 pairs of beams would point in the same direction.

As is known, the beamwidth (B) of a radio frequency beam produced by an array antenna is governed by the equation:

$$B=K\lambda/d \quad (2)$$

where d is the diameter of the array antenna (i.e., D for individual subarrays 14*a*, 14*b*) forming the beam and K is a constant of proportionality, the value of which is a function of the illumination of the antenna aperture. As is known, K equals 51 for an aperture (such as subarrays 14*a*, 14*b* of antenna elements $\mathbf{12}_{1}$–$\mathbf{12}_{35}$, $\mathbf{12}_{36}$–$\mathbf{12}_{70}$) having uniform illumination. The quantity λ is the wavelength of the radio frequency of interest, which conventionally is selected in equation (2) to correspond to the highest operating frequency ($f_H$) at which antenna system 10 is designed to operate in order to make adjacent beams cross over each other at −3dB at such upper limit frequency $f_H$.

Figure 2B:
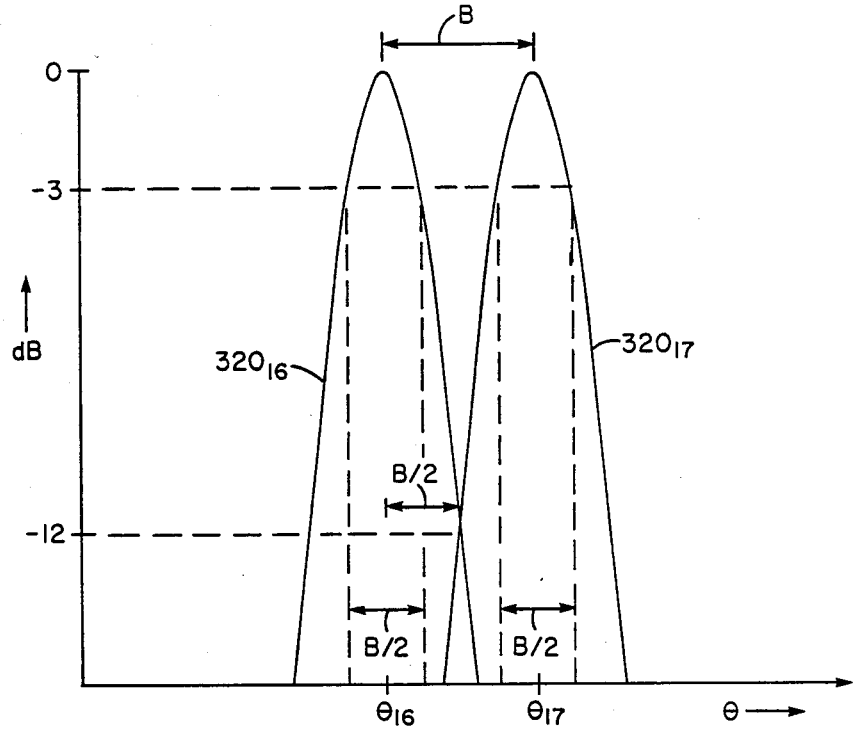
FIGS. 2A and 2B are pattern plots of beams useful in understanding the array antenna system of FIG. 1.
Figure 2A:
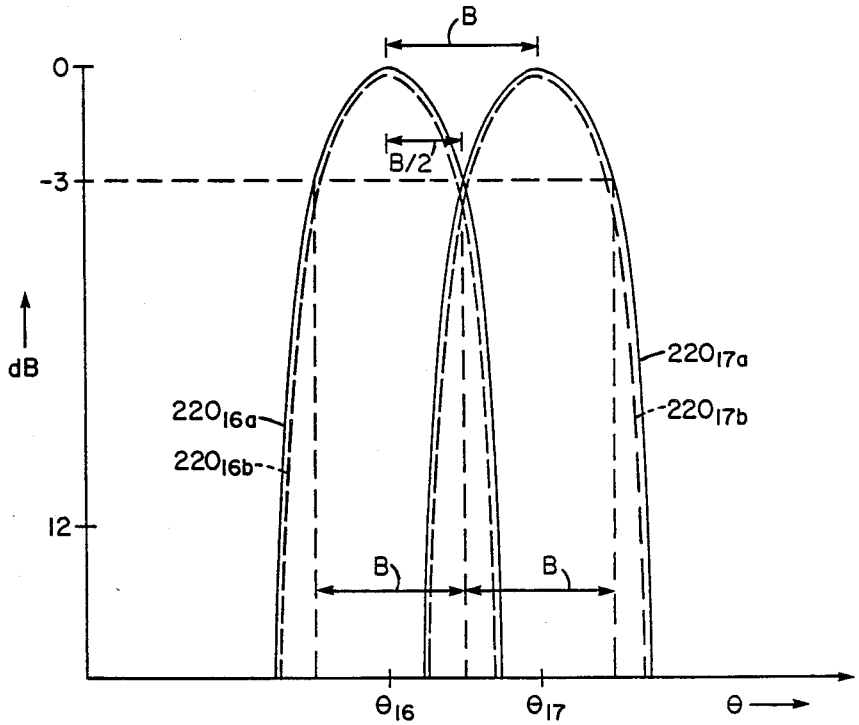

Referring now to FIG. 2A, pairs of beam patterns associated with beam ports $\mathbf{20}_{16a}$, $\mathbf{20}_{16b}$ and $\mathbf{20}_{17a}$, $\mathbf{20}_{17b}$ disposed at nominal beam port positions $\mathbf{120}_{16}$ and $\mathbf{120}_{17}$, respectively, are graphically illustrated as a function of antenna gain in dB vs. beam pattern angle θ. As shown, lenses 16*a*, 16*b* and subarrays 14*a*, 14*b*, respectively, form a pair of overlaying beams $\mathbf{220}_{16a}$, $\mathbf{220}_{16b}$ associated with beam ports $\mathbf{20}_{16a}$, $\mathbf{20}_{16b}$, each beam $\mathbf{220}_{16a}$, $\mathbf{220}_{16b}$ having a width B and a pattern at an angle $\theta_{16}$, relative to boresight axis 60, corresponding to nominal beam port location $\mathbf{120}_{16}$. It is noted that overlaying beams $\mathbf{220}_{16a}$, $\mathbf{220}_{16b}$ are shown slightly separated in FIG. 2A for purposes of clarity of illustration. Likewise, lenses 16*a*, 16*b* and subarrays 14*a*, 14*b*, respectively, form a pair of overlaying beams $\mathbf{220}_{17a}$, $\mathbf{220}_{17b}$ associated with beamports $\mathbf{20}_{17a}$, $\mathbf{20}_{17b}$, respectively, each beam having a width, B, and pointing at an angle $\theta_{17}$, relative to boresight axis 60, corresponding to nominal beam port location $\mathbf{120}_{17}$. Adjacent beam pairs $\mathbf{220}_{16a}$–$\mathbf{220}_{16b}$, $\mathbf{220}_{17a}$–$\mathbf{220}_{17b}$ are spaced in accordance with the spacing between beamports $\mathbf{20}_{16a}$–$\mathbf{20}_{16b}$ and $\mathbf{20}_{17a}$, $\mathbf{20}_{17b}$, respectively, and thus beam pair $\mathbf{220}_{16a}$–$\mathbf{220}_{16b}$ is spaced from beam pair $\mathbf{220}_{17a}$–$\mathbf{220}_{17b}$ by B. Since such beam pairs have −3dB beam widths of B, a little thought reveals that such adjacent pairs of beams $\mathbf{220}_{16a}$–$\mathbf{220}_{16b}$, $\mathbf{220}_{17a}$–$\mathbf{220}_{17b}$ cross over each other at the −3dB points thereof at B/2 from the peaks of such beams. That is, the adjacent pairs of overlaying beams forming by individual lenses 16*a*, 16*b* and subarrays 14*a*, 14*b*, respectively, have high-frequency crossovers at −3dB down from the peaks thereof.

Each pair of overlaying beams associated with individual lenses and subarrays 16*a*–14*a*, 16*b*–14*b*, respectively, is spatially combined by the entire array 14 of antenna elements $\mathbf{12}_{1}$–$\mathbf{12}_{70}$ into a single composite beam. For example, and referring to FIG. 2B, beam $\mathbf{220}_{16a}$ is spatially combined with beam $\mathbf{220}_{16b}$ by the entire array 14 of antenna elements $\mathbf{12}_{1}$–$\mathbf{12}_{70}$ to form a single composite beam $\mathbf{320}_{16}$ having a pattern pointing at an angle relative to boresight axis 60 determined by the angles of beam pair $\mathbf{220}_{16a}$, $\mathbf{220}_{16b}$. Since such pair of beams would point in the direction $\theta_{16}$ with beam ports $\mathbf{20}_{16a}$, $\mathbf{20}_{16b}$ disposed at nominal beam port location $\mathbf{120}_{16}$, composite beam $\mathbf{320}_{16}$ also has a peak pointing at an angle $\theta_{16}$ from boresight axis 60, as shown. A little thought thus reveals that 32 composite beams would be formed by array 14 by spatially combining the 32 pairs of overlaying beams formed by lens 16*a*/subarray 14*a* and lens 16*b*/subarray 14*b*. Since each composite beam (for example, composite beam $\mathbf{320}_{16}$) is formed with the entire array 14 of antenna elements $\mathbf{12}_{1}$–$\mathbf{12}_{70}$, the aperture of diameter therefor is 2D (see FIG. 1)–twice that for the constituent pair of beams (that is, beams $\mathbf{220}_{16a}$, $\mathbf{220}_{16b}$) produced by each lens and subarray 16*a*/14*a*, 16*b*/14*b*, respectively. Thus, in accordance with equation (2), the beamwidth of each one of the 32 composite beams would be one-half the width of each one of the 32 beams formed by each lens and subarray 16*a*/14*a*, 16*b*/14*b* individually, that is, B/2. As shown in FIG. 2B, the composite beam $\mathbf{320}_{17}$ formed by spatial combination of beam pair $\mathbf{220}_{17a}$, $\mathbf{220}_{17b}$ has a pattern, at $\theta_{17}$, separated from the pattern of composite beam $\mathbf{320}_{16}$ by B, since $\theta_{16}$ and $\theta_{17}$ are separated by B. The crossover of such adjacent composite beams $\mathbf{320}_{16}$, $\mathbf{320}_{17}$ (and of all adjacent ones of the 32 composite beams) is determined by:

$$\text{Crossover}=(2\theta_c/BW)^2\cdot(-3\text{dB}) \quad (3)$$

where θc is the angle from the peak of each beam to the crossover point and BW is the beamwidth of each composite beam (here, B/2). Thus, since the crossovers occur one composite beamwidth from the peak of each composite beam, adjacent composite beams (e.g., beams $\mathbf{320}_{16}$, $\mathbf{320}_{17}$) are seen to have high frequency crossovers that are 12dB down from the beam peaks. Such "deep" crossovers would produce "holes" in the coverage of the array antenna system, since greatly reduced power would be radiated (or received) by the array in the angular direction of each −12dB crossover. The "holes" could be filled, and −3dB crossovers established for the composite beams, by doubling the number of beam ports on each lens 16*a*, 16*b* (e.g., from 32 to 64). However, such would greatly increase the complexity of each lens 16*a*, 16*b* and, as will become clear, would require doubling the size of each switch 26*a*, 26*b* (e.g., from SP32T to SP64T) so that each one of such 64 beam ports on each lens 16*a*, 16*b* could be accessed.

The present invention solves these problems by "skewing" the actual location of corresponding ones of beam ports $\mathbf{20}_{1a}$,–$\mathbf{20}_{32a}$, $\mathbf{20}_{1b}$–$\mathbf{20}_{32b}$ from each other by a predetermined amount in sin θ space, rather than disposing beamports $\mathbf{20}_{1a}$–$\mathbf{20}_{32a}$, $\mathbf{20}_{1b}$–$\mathbf{20}_{32b}$ at the nominal locations $\mathbf{120}_{1}$–$\mathbf{120}_{32}$, respectively, thereof. As will become clear, in the general case, the amount of "skew" (expressed in beam widths) between corresponding beamports (e.g., beam ports $\mathbf{20}_{1a}$, $\mathbf{20}_{1b}$) is equal to the beam port spacing S (equation #1) multiplied by the reciprocal of the number (M) of modular lenses included in a given array antenna system (i.e. skew=S/M). Thus, in array antenna system 10 (FIG.

1), corresponding beam ports $20_{1a}$, $20_{1b}$–$20_{32a}$, $20_{32b}$ are spaced from each other in sin $\theta$ space by a distance corresponding to one-half of the spacing between adjacent nominal beam port locations $120_1$–$120_{32}$. As discussed above, adjacent nominal beam port locations $120_1$–$120_{32}$ are spaced at intervals of S=0.0456 in sin $\theta$ space (see equation #1). Thus, in the present invention, corresponding beam ports $20_{1a}$, $20_{1b}$–$20_{32a}$, $20_{32b}$ are spaced from each other (i.e. skewed) by 0.0456/2 in sin $\theta$ space. Here, beam ports $20_{1a}$–$20_{32a}$ of lens 16a are offset in the clockwise direction from respective nominal beam port locations $120_1$–$120_{32}$ by $\frac{1}{4}$ spacing–that is, a distance of −0.0456/4 in sin $\theta$ space from such nominal locations $120_1$–$120_{32}$ while beam ports $20_{1b}$–$20_{32b}$ of lens 16b are offset $\frac{1}{4}$ space counterclockwise (i.e., +0.0456/4) in sin $\theta$ space from respective nominal beam port locations $120_1$–$120_{32}$. For example, and referring to Table I, as discussed, nominal beam port location $120_{16}$ is positioned on surfaces 21a, 21b at a distance of +0.0456/2 (+0.0228) in sin $\theta$ space from "0" reference axes of symmetry 17a, 17b, respectively.

TABLE I

| Nominal Beam Port Position (sin Θ space) | Skewed Beam Port Position (sin Θ space) Lens 16a | Skewed Beam Port Position (sin Θ space) Lens 16b | Beam Direction (degrees) Lens 16a $\Theta_{(1-32)a}$ | Beam Direction (degrees) Lens 16b $\Theta_{(1-32)b}$ | Equalization Cable Lengths ΔL Lens 16a | Equalization Cable Lengths ΔL Lens 16b |
|---|---|---|---|---|---|---|
| ($120_1$) +0.707 | +0.696 | +0.719 | −44.08 | −45.93 | 0 | 0.70D |
| ($120_2$) 0.6612 | 0.650 | 0.673 | −40.55 | −42.29 | 0 | 0.65D |
| ($120_3$) 0.6156 | 0.604 | 0.627 | −37.19 | −38.85 | 0 | 0.60D |
| ($120_4$) 0.570 | 0.559 | 0.582 | −33.98 | −35.57 | 0 | 0.56D |
| ($120_5$) 0.5244 | 0.513 | 0.536 | −30.88 | −32.41 | 0 | 0.51D |
| ($120_6$) 0.4788 | 0.468 | 0.490 | −27.88 | −29.37 | 0 | 0.48D |
| ($120_7$) 0.4332 | 0.422 | 0.445 | −24.96 | −26.41 | 0 | 0.42D |
| ($120_8$) 0.3876 | 0.376 | 0.399 | −22.11 | −23.53 | 0 | 0.38D |
| ($120_9$) 0.342 | 0.331 | 0.354 | −19.31 | −20.71 | 0 | 0.33D |
| ($120_{10}$) 0.2964 | 0.285 | 0.308 | −16.57 | −17.94 | 0 | 0.29D |
| ($120_{11}$) 0.2508 | 0.240 | 0.262 | −13.86 | −15.21 | 0 | 0.24D |
| ($120_{12}$) 0.2052 | 0.194 | 0.217 | −11.18 | −12.52 | 0 | 0.19D |
| ($120_{13}$) 0.1596 | 0.148 | 0.171 | −8.53 | −9.85 | 0 | 0.15D |
| ($120_{14}$) 0.114 | 0.103 | 0.125 | −5.89 | −7.21 | 0 | 0.10D |
| ($120_{15}$) 0.0684 | 0.057 | 0.080 | −3.27 | −4.58 | 0 | 0.06D |
| ($120_{16}$) +0.0228 | +0.0114 | +0.034 | −0.653 | −1.961 | 0 | 0.01D |
| ($120_{17}$) −0.0228 | −0.034 | −0.0114 | +1.961 | +0.653 | 0.01D | 0 |
| ($120_{18}$) 0.0684 | −0.080 | −0.057 | 4.58 | 3.27 | 0.06D | 0 |
| ($120_{19}$) 0.114 | −0.125 | −0.103 | 7.21 | 5.89 | 0.10D | 0 |
| ($120_{20}$) 0.1596 | −0.171 | −0.148 | 9.85 | 8.53 | 0.15D | 0 |
| ($120_{21}$) 0.2052 | −0.217 | −0.194 | 12.52 | 11.18 | 0.19D | 0 |
| ($120_{22}$) 0.2508 | −0.262 | −0.240 | 15.21 | 13.86 | 0.24D | 0 |
| ($120_{23}$) 0.2964 | −0.308 | −0.285 | 17.94 | 16.57 | 0.29D | 0 |
| ($120_{24}$) 0.342 | −0.354 | −0.331 | 20.71 | 19.31 | 0.33D | 0 |
| ($120_{25}$) 0.3876 | −0.399 | −0.376 | 23.53 | 22.11 | 0.38D | 0 |
| ($120_{26}$) 0.4332 | −0.445 | −0.422 | 26.41 | 24.96 | 0.42D | 0 |
| ($120_{27}$) 0.4788 | −0.490 | −0.468 | 29.37 | 27.88 | 0.48D | 0 |
| ($120_{28}$) 0.5244 | −0.536 | −0.513 | 32.41 | 30.88 | 0.51D | 0 |
| ($120_{29}$) 0.570 | −0.582 | −0.559 | 35.57 | 33.98 | 0.56D | 0 |
| ($120_{30}$) 0.6156 | −0.627 | −0.604 | 38.85 | 37.19 | 0.60D | 0 |
| ($120_{31}$) 0.6612 | −0.673 | −0.650 | 42.29 | 40.55 | 0.65D | 0 |
| ($120_{32}$) −0.707 | −0.719 | −0.696 | +45.93 | +44.08 | 0.70D | 0 |

Here, beam port $20_{16a}$ is offset clockwise on surface 21a (i.e., toward axis 17a) by −0.0456/4 in sin $\theta$ space to a position of +0.0114 on surface 21a with respect to axis 17a, and beam port $20_{16b}$ is offset counterclockwise on surface 21b (i.e., away from axis 17b) by +0.0456/4 in sin $\theta$ space to a position of +0.034 on surface 21b with respect to axis 17b. The positions of "skewed" beam ports $20_{1a}$–$20_{32}$, $20_{1b}$–$20_{32b}$, along with the nominal locations thereof, are listed in Table I.

The direction of a given beam formed by each lens 16a, 16b is a function of the negative of the arc sine of the position of the corresponding beam port on lens surfaces 21a, 21b, respectively. For example, (and assuming a lens expansion factor of 1.0) it is seen that the beam formed by lens 16a associated with skewed beam port $20_{16a}$ makes an angle of −0.653° (−arc sin 0.0114) with boresight axis 60. The beam formed by lens 16b from skewed beam port $20_{16b}$ has an angular deviation of −1.96° (−arc sin 0.0342) from boresight axis 60. Since a beam having an angle from boresight of −1.3° would be formed at nominal beam port location $120_{16}$ (−arc sin 0.0228), it is seen that the pair of beams formed by lenses 16a, 16b in accordance with a corresponding pair of skewed beam ports (such as ports $20_{16a}$, $20_{16b}$) have different pointing directions and in fact here point to either side of the beam pointing direction associated with the corresponding nominal beam port location (such as location $120_{16}$). The pointing directions of beams formed by the corresponding pairs of skewed beam ports $20_{1a}$, $20_{1b}$–$20_{32a}$, $20_{32b}$ are also listed in Table I.

Figure 3B:
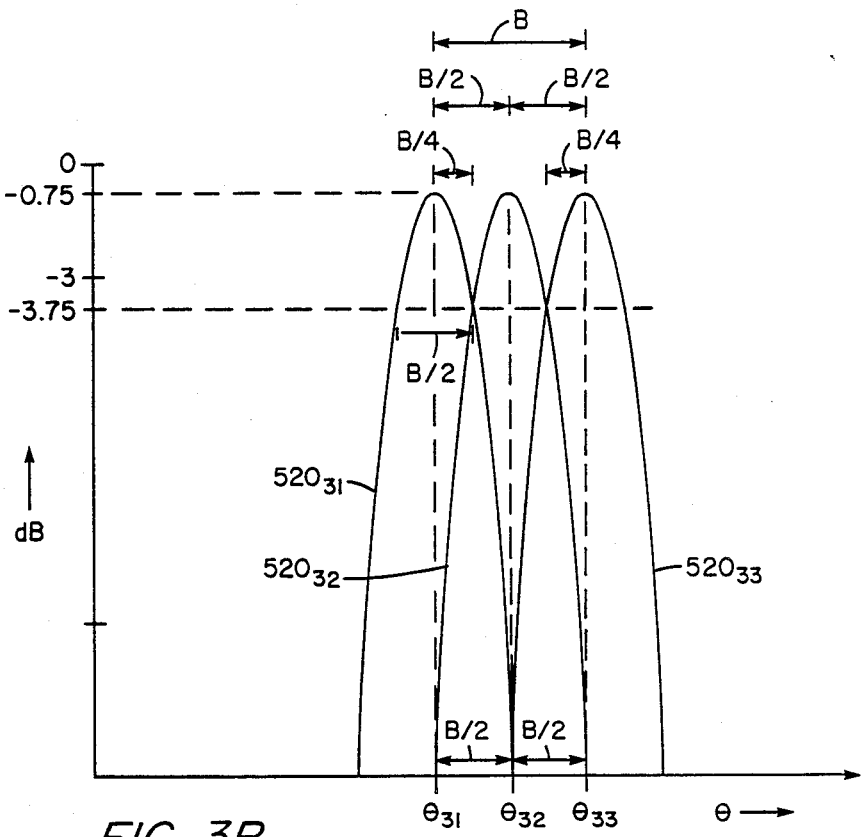
FIGS. 3A and 3B are beam patterns produced by the array antenna system of FIG. 1.
Figure 3A:
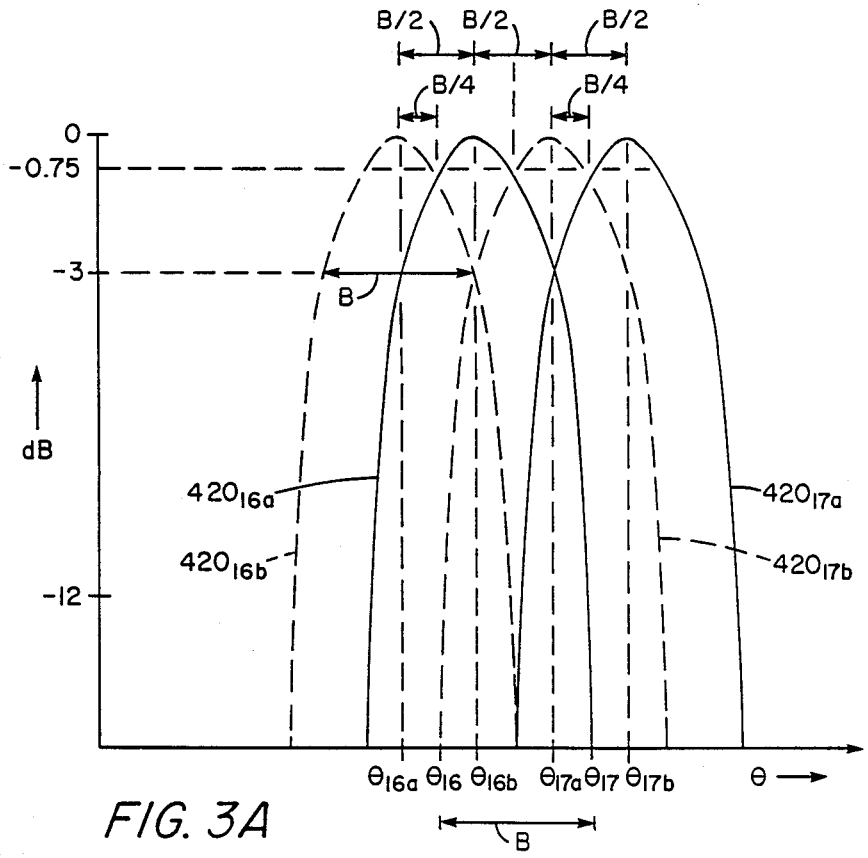

Thus, it is seen that lenses 16a, 16b, with corresponding beam ports $20_{1a}$, $20_{1b}$–$20_{32a}$, $20_{32b}$ skewed from each other by one-half spacing in sin $\theta$ space, form two sets of 32 beams $420_{1a}$, $420_{1b}$–$420_{32a}$, $420_{32b}$, respectively, with beams associated with corresponding beam ports having patterns which are non-overlaying and which point in different directions. Referring to FIG. 3A and Table I, beams $420_{16a}$, $420_{17a}$, $420_{16b}$, $420_{17b}$ formed by lenses 16a, 16b and subarrays 14a, 14b and associated with adjacent skewed beam ports $20_{16a}$, $20_{17a}$, $20_{16b}$, $20_{17b}$, respectively, thereof are illustrated. As shown, the beams formed by each lens and subarray remain B-width beams. The pair of beams $420_{16a}$, $420_{16b}$ formed in accordance with corresponding skewed beam ports $20_{16a}$, $20_{16b}$ are overlapping but non-overlaying beams having patterns skewed by substantially one-half of the beamwidth of such beams, since the associated beam ports for such beams are offset from each other by one-half spacing (0.0456/2) in sin $\theta$ space, as has been discussed. Further, the pointing directions $\theta_{16a}$, $\theta_{16b}$ of such beams are $\pm\frac{1}{4}$ beam width (i.e., B/4) from the beam angle $\theta_{16}$ associated with nominal beam port location $\mathbf{120}_{16}$. Likewise, the pair of beams $\mathbf{420}_{17a}$, $\mathbf{420}_{17b}$ formed in accordance with corresponding skewed beam ports $\mathbf{20}_{17a}$, $\mathbf{20}_{17b}$ are B-width beams having patterns skewed by substantially one-half of the beamwidth thereof. The beams have angular deviations $\theta_{17a}$, $\theta_{17b}$, respectively, from boresight which are $\pm\frac{1}{4}$ beam width from the angular deviation $\theta_{17}$ associated with nominal beam port location $\mathbf{120}_{17}$. Study of FIG. 3A with Table I and FIG. 1 reveals that lenses 16*a*, 16*b* and subarrays 14*a*, 14*b* form a pair of sets of 32 beams each, the 32 beams $\mathbf{420}_{1a}$–$\mathbf{420}_{32a}$ formed by lens 16*a* and subarray 14*a* being interleaved with the 32 beams $\mathbf{420}_{1b}$–$\mathbf{420}_{32b}$ formed by lens 16*b* and subarray 14*b*. Application of equation (3) to such beams reveals that adjacent B-width beams have high-frequency crossovers at −0.75dB ($\theta_c$ equaling B/4, as shown).

Interleaved beams $\mathbf{420}_{1a}$, $\mathbf{420}_{1b}$–$\mathbf{420}_{32a}$, $\mathbf{420}_{32b}$ formed by lenses 16*a*, 16*b* and subarrays 14*a*, 14*b* are spatially combined by the entire array 14 of antenna elements $\mathbf{12}_1$–$\mathbf{12}_{70}$ to form a plurality of 2N−1 composite beams, where N is the number of beams formed by individual lenses 16*a*, 16*b* and subarrays 14*a*, 14*b* (i.e. N=32). Thus, here 63 composite beams $\mathbf{520}_1$–$\mathbf{520}_{63}$ are formed, each composite beam having a beamwidth equal to one-half of the beamwidth of the constituent beams due to the doubling of the effective aperture (from D to 2D) therefor. That is, each composite beam has a 3dB beamwidth of B/2. Each composite beam is formed by the spatial combination of adjacent ones of the interleaved beams formed individually by lens 16*a*, subarray 14*a* and lens 16*b*, subarray 14*b*. For example, beams $\mathbf{420}_{1a}$, $\mathbf{420}_{1b}$ form composite beam $\mathbf{520}_1$, with beams $\mathbf{420}_{1a}$, $\mathbf{420}_{2b}$ forming composite beam $\mathbf{520}_2$, and so on, with beams $\mathbf{420}_{32a}$, $\mathbf{420}_{32b}$ combining to form composite beam $\mathbf{520}_{63}$. Thus, referring to FIG. 3B, it follows that beams $\mathbf{420}_{16a}$, $\mathbf{420}_{16b}$ are spatially combined by antenna elements $\mathbf{12}_1$–$\mathbf{12}_{70}$ to form composite beam $\mathbf{520}_{31}$, with beams $\mathbf{420}_{16a}$, $\mathbf{420}_{17b}$ likewise being spatially combined to form composite beam $\mathbf{520}_{32}$, and beams $\mathbf{420}_{17a}$, $\mathbf{420}_{17b}$ combining to form composite beam $\mathbf{520}_{33}$. Comparison of FIGS. 3A and 3B shows that each composite beam has a pattern pointing in a direction intermediate the directions of the patterns of the pair of beams which combine to form such composite beam. That is, each composite beam has an angular deviation $\theta$ from boresight axis 60 intermediate the angular deviations of the adjacent interleaved beams which combine to form such composite beam. For example, composite beam $\mathbf{520}_{31}$ is projected at an angle $\theta_{31}$ intermediate the angles $\theta_{16a}$, $\theta_{16b}$ of beams $\mathbf{420}_{16a}$, $\mathbf{420}_{16b}$, respectively. Likewise, composite beam $\mathbf{520}_{32}$ points at angle $\theta_{32}$ intermediate the pointing angles $\theta_{16b}$, $\theta_{17a}$ of beams $\mathbf{420}_{16b}$, $\mathbf{420}_{17a}$. Also, composite beam $\mathbf{520}_{33}$ points at an angle $\theta_{33}$ intermediate the angular deviations $\theta_{17a}$, $\theta_{17b}$ of beams $\mathbf{420}_{17a}$, $\mathbf{420}_{17b}$. A little thought reveals that angles $\theta_{31}$, $\theta_{33}$ are identical to the angles $\theta_{16}$, $\theta_{17}$ that would be formed by composite beams associated with nominal beam port locations $\mathbf{120}_{16}$, $\mathbf{120}_{17}$, respectively, and that angle $\theta_{32}$ is disposed mid-way between angles $\theta_{31}$, $\theta_{33}$.

As shown in FIG. 3B, adjacent B/2-width composite beams, for example, beams $\mathbf{520}_{31}$, $\mathbf{520}_{32}$, have high frequency crossovers at one-half beamwidth (B/4) from the peaks thereof. Thus, from equation (3) it is seen that such adjacent composite beams have high frequency crossovers which are down only 3dB from the peaks thereof, thereby providing substantially uniform coverage over the area scanned by array antenna system 10. It is noted that since such composite beams are formed at the crossover points between adjacent B-width beams (e.g., beams $\mathbf{420}_{16a}$, $\mathbf{420}_{16b}$, $\mathbf{420}_{17a}$, $\mathbf{420}_{17b}$), the gain of the composite beams formed from skewed beam ports $\mathbf{20}_{1a}$, $\mathbf{20}_{1b}$–$\mathbf{20}_{32a}$, $\mathbf{20}_{32b}$ is slightly less than that of the composite beams which would be formed from non-skewed nominal beam port locations $\mathbf{120}_1$–$\mathbf{120}_{32}$. For example, and referring also to FIGS. 2A, 2B, overlaying beams $\mathbf{220}_{16a}$, $\mathbf{220}_{16b}$ which would be formed by lenses 16*a*, 16*b* and subarrays 14*a*, 14*b* in accordance with nominal beam port location $\mathbf{120}_{16}$ would combine to form a composite beam ($\mathbf{320}_{16}$) having a pattern pointing in the same direction as the patterns of the pair of beams $\mathbf{220}_{16a}$, $\mathbf{220}_{16b}$. Thus the relative gain of such composite beam $\mathbf{320}_{16}$ would be:

$$\begin{aligned} \text{Gain} &= 20 \log \frac{1}{\sqrt{2}} [2] \text{ dB} \\ &= +3.01 \text{ dB} \end{aligned} \tag{4}$$

However, referring again to FIGS. 3A, 3B, it is seen that composite beam $\mathbf{520}_{31}$, for example, has a pattern pointing intermediate the directions of the patterns of constituent beams $\mathbf{420}_{16a}$, $\mathbf{420}_{16b}$. More specifically, it is seen that composite beam $\mathbf{520}_{31}$ is disposed at the high frequency crossover point between such adjacent constituent beams $\mathbf{420}_{16a}$, $\mathbf{420}_{16b}$. As discussed, such crossover point is at −0.75dB with respect to the peaks (normalized at 0dB) of such beams $\mathbf{420}_{16a}$, $\mathbf{420}_{16b}$. Thus, the gain of composite beam $\mathbf{520}_{31}$ (and in fact of all of the 63 composite beams $\mathbf{520}_1$–$\mathbf{520}_{63}$ formed by array antenna system 10) is seen to be:

$$\begin{aligned} \text{Gain} &= 20 \log \frac{1}{\sqrt{2}} [10^{\frac{-0.75}{20}} + 10^{\frac{-0.75}{20}}] \text{ dB} \\ &= +2.26 \text{ dB} \end{aligned} \tag{5}$$

Comparison of equations (4) and (5) reveals that the gain of composite beams $\mathbf{520}_1$–$\mathbf{520}_{63}$ is 0.75dB down from the gain of composite beams $\mathbf{320}_1$–$\mathbf{320}_{32}$. Such gain reduction is possibly due to the fact that composite beams $\mathbf{520}_1$–$\mathbf{520}_{63}$ are in practice approximately 10% more than one-half of the beamwidth of constituent beams $\mathbf{420}_{1a}$–$\mathbf{420}_{32a}$, $\mathbf{420}_{1b}$–$\mathbf{420}_{32b}$ due to the skewing of such constituent beams. Taking the above-discussed +3.01dB gain as a 0dB reference, the high frequency crossovers between composite beams $\mathbf{520}_1$–$\mathbf{520}_{63}$ are actually 3.75dB down with respect to such 0dB reference. However, such small decrease in gain is more than offset by the achievement of 3dB high-frequency crossovers (with respect to the peaks of the composite beams) between composite beams and the concomitant elimination of "holes" in the coverage provided by array antenna system 10.

Referring again to FIG. 1, one mode of operation of array antenna system 10 will now be discussed. As previously stated, array antenna system 10 here is a transmitting system. Transmitter 24 produces a radio frequency (RF) signal which is power-divided and coupled in phase to the poles of SP32T switches 26*a*, 26*b* by power divider/combiner 28. Switches 26a, 26b here are initially set to positions $40_{1a}$, $40_{1b}$, respectively thereof. Thus, initially, such RF signal here is coupled to skewed beam ports $20_{1a}$, $20_{1b}$ of lenses 16a, 16b. As shown in Table I, lenses 16a, 16b and subarrays 14a, 14b form a pair of B-width beams ($420_{1a}$, $420_{1b}$) having angular deviations ($\theta_{1a}$, $\theta_{1b}$) of approximately −44.08° and −45.93° with respect to boresight axis 60 in response to such RF signal. Such pair of beams $420_{1a}$, $420_{1b}$ are spatially combined by array 14 to form a B/2-width composite beam ($520_1$) having a peak pointing at approximately −45° ($\theta_1$) with respect to boresight axis 60. Controller 30 here alternately increments switches 26b, 26a (i.e., starting with switch 26b) until the switches are set to contacts $40_{32a}$, $40_{32b}$. Thus, switch 26b is first incremented to position $40_{2b}$ with switch 26a remaining set to contact $40_{1a}$. Lens 16b and subarray 14b thus form a new B-width beam ($420_{2b}$) having an angular deviation ($\theta_{2b}$) of about −42.24° (with respect to boresight), while the beam $420_{1a}$ produced by lens 16a and subarray 14a is maintained (at about −44.08°). Thus, array 14 forms a new B/2-width composite beam $520_2$ directed at an angle $\theta_2$ substantially bisecting the angles of the pair of constituent beams ($420_{1a}$, $420_{2b}$), that is, at an angle of approximately −43.16°. Then, switch 26a is incremented to contact $40_{2a}$, forming (with subarray 14a) a new B-width beam ($420_{2a}$) at an angle ($\theta_{2a}$) of about −40.55°, such new beam $420_{2a}$ being spatially combined with the beam $420_{2b}$ produced by lens 16b and subarray 14b (with switch 26b set at contact $40_{2b}$) to form a new B/2-width composite beam $520_3$ having an angular deviation ($\theta_3$) substantially −41.42° from boresight axis 60. Such incremental switching here continues until both switches are at contacts $40_{32a}$, $40_{32b}$, resulting in a composite beam $520_{63}$ being directed at $\theta_{63}$ (about +45°) with respect to boresight axis 60. Thus, a little thought reveals that the RF energy is here directed across the 90° scanning sector in 63 successively formed, half-beamwidth composite beams. In general, the number of composite beams which may be formed equals (2N−1), where N is the number of beamports on each lens. Thus, beam positions may be added or deleted in the present invention merely by increasing or decreasing a predetermined number of beam ports from lenses 16a, 16b. In any event, it is noted that with the present invention, a plurality of (2N−1) beams having −3dB high frequency crossovers (with respect to the peaks thereof) are formed with a plurality, such as two, of relatively small, modular beam forming lenses, with each lens requiring only N beam ports. Also, the switches used to scan the (2N−1) beams need only have N positions, thereby allowing reduced complexity switches to be used.

As discussed, each beam produced by individual lens 16a, subarray 14a (beams $420_{1a}$–$420_{32a}$) and lens 16b, subarray 14b (beams $420_{1b}$–$420_{32b}$) has a planar wavefront associated therewith disposed perpendicularly to the beam. The wavefronts of a given pair of B-width beams associated with corresponding beam ports on lenses 16a, 16b here are brought into substantial phase alignment with equalization length cables $50_{1a}$–$50_{32a}$, $50_{1b}$–$50_{32b}$, thereby allowing substantially frequency-independent beams to be produced by lenses 16a, 16b and subarrays 14a, 14b. That is, a selected one of each pair of corresponding cables (i.e., cables $50_{1a}$, $50_{1b}$–$50_{32a}$, $50_{32b}$) has length different from the other one of such pair of corresponding cables $50_{1a}$, $50_{1a}$–$50_{32a}$, $50_{32b}$ by a predetermined amount ΔL. More specifically, and referring to FIG. 1, B-width beams formed by lens 16a, subarray 14a and lens 16b, subarray 14b in response to RF energy applied to beam ports $20_{1a}$–$20_{16a}$, $20_{1b}$–$20_{16b}$, respectively, thereof are directed at negative angles with respect to boresight axis 60 (i.e., to the left of boresight axis 60 in FIG. 1), as discussed. Thus RF energy radiated by subarray 14a of antenna elements $12_1$–$12_{35}$ has further to travel to a given planar wavefront associated with such energy than does energy emanated by the antenna elements $12_{36}$–$12_{70}$ of subarray 14b. For example, consider beam $420_{1a}$ formed by lens 16a and subarray 14a in response to energy applied to beam port $20_{1a}$ of such lens 16a via cable $50_{1a}$. Referring to Table I, such beam $420_{1a}$ has a angular deviation $\theta_{1a}$ from boresight axis 60 of about −44.08°. As may be appreciated from FIG. 1, over the diameter (D) of each subarray 14a, 14b, a beam of energy (such as beam $420_{1a}$) directed to the left of boresight (i.e., at a negative angle with respect thereto) must travel an additional distance ΔL to arrive at the planar wavefront of energy $420'_{1a}$, associated with such beam $420_{1a}$, where:

$$\Delta L = D \sin \phi \tag{6}$$

In the above example, $\phi = \theta_{1a} = (-44.08°)$. Thus, an equalization length (ΔL) of 0.70D here is added to the cable $50_{1b}$ coupled to corresponding beam port $20_{1b}$ of the other lens 16b, thereby compensating for the additional travel distance ΔL required of energy associated with such beam port $20_{1a}$ of lens 16a, bringing the wavefronts of the pair of beams formed by lenses 16a, 16b and subarrays 14a, 14b due to energy applied to beam ports $20_{16a}$, $20_{16b}$ into substantial phase alignment. A little thought reveals that equalization lengths (ΔL) are added to cables $50_{1b}$–$50_{16b}$ with respect to corresponding cables $50_{1a}$–$50_{16a}$ in accordance with equation (6) and the angles of the beams formed by lens 16a in response to RF energy applied to corresponding beam ports $20_{1a}$–$20_{16a}$ of such lens 16a. Such added lengths are listed in Table I.

Conversely, and as discussed, energy from beams directed to the right of boresight axis 60 (i.e., at positive angles with respect thereto) correspond to beam ports $20_{17a}$–$20_{32a}$ of lens 16a and beamports $20_{17b}$–$20_{32b}$ of lens 16b. Applying the above analysis to such beams, it may be appreciated that equalization lengths ΔL here are added to cables $50_{17a}$–$50_{32a}$ feeding beam ports $20_{17a}$–$20_{32a}$, respectively, with respect to the lengths of corresponding cables $50_{17b}$–$50_{32b}$, respectively, in accordance with equation (6). For example, energy applied to beam port $20_{30b}$ of lens 16b results in a B-width beam ($420_{30b}$) having an angle $\theta_{30b}$ of about +37.19°. Thus, a corresponding length ΔL of approximately 0.60D is here added to the cable $50_{30a}$ feeding corresponding beam port $20_{30a}$ of the other lens 16a. Similarly, equalization lengths ΔL determined by equation (6) are added to cables $50_{17a}$–$50_{32a}$ in accordance with the angles of the beams formed by lens 16b (and subarray 14b) in response to energy applied to corresponding beam ports $20_{17b}$–$20_{32b}$. The equalization lengths of cables $50_{17a}$–$50_{32a}$ are listed in Table I.

Figure 4:
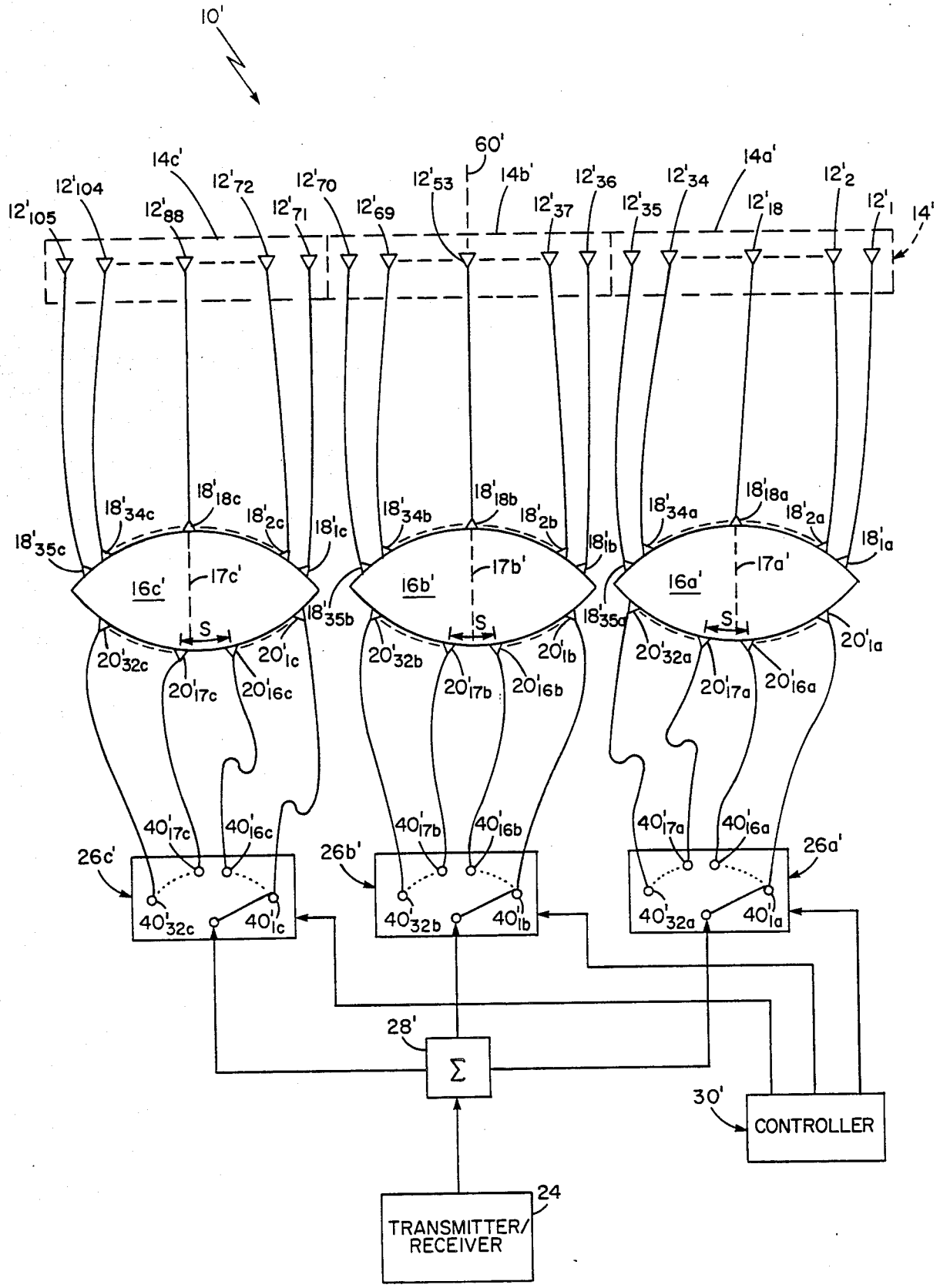
FIG. 4 is a schematic diagram of an alternate embodiment of the array antenna system of the present invention.

Referring to FIG. 4, an alternate embodiment of array antenna system 10' according to the invention is shown comprising three modular beam forming lenses 16a', 16b', 16c' coupled to an array 14' of antenna elements $12_1'$–$12_{105}'$. Array ports $18_{1a}'$–$18_{35a}'$ of lens 16a' are coupled via coaxial cables to corresponding antenna elements $12_1'$–$12_{35}'$, such antenna elements $12_1'$–$12_{35}'$ being arranged in subarray 14a'. Likewise, antenna elements $12_{36}'$–$12_{70}'$ are arranged in subarray 14b' and are correspondingly coupled to array ports $18_{1b}'$–$18_{35b}'$ of lens 16b' through coaxial cables. Similarly, lens 16c' comprises array ports $18_{1c}'$–$18_{35c}'$ which are applied through coaxial cables to subarray 14c' of antenna elements $12_{71}'$–$12_{105}'$.

Lenses 16a', 16b', 16c' each comprise a set of, here 32, beam ports $20_{1a}'$–$20_{32a}'$, $20_{1b}'$–$20_{32b}'$, $20_{1c}'$–$20_{32c}'$, respectively, and thus are each capable of forming 32 distinct beams. In accordance with this embodiment of the invention, beam ports $20_{1b}'$–$20_{32b}'$ are equally spaced at intervals of 0.0456 in sin $\theta$ space (see equation #1) on surface 21b' of lens 16b' at nominal beam port positions $120_1$–$120_{32}$ (see FIG. 1), respectively, to form, along with antenna elements $12_{36}'$–$12_{70}'$ of subarray 14b', 32 beams $420_{1b}'$–$420_{32b}'$ directed with angular deviations $\theta_{1b}'$–$\theta_{32b}'$, respectively, from boresight axis 60'. Such beams have a predetermined beamwidth determined in accordance with equation (2), such beamwidth here being denoted as B'. Beam ports $20_{1a}'$–$20_{32a}'$ are offset clockwise by one-third of such a beam port spacing in sin $\theta$ space (i.e. $-0.0456/3$) on focal arc surface 21a' of lens 16a' with respect to the position of beam ports $20_{1b}'$–$20_{32b}'$ on lens 16b'. Thus, lens 16a', along with antenna elements $12_1'$–$12_{35}'$ of subarray 14a', forms 32 beams $420_{1a}'$–$420_{32a}'$ with angular deviations from boresight of $\theta_{1a}'$–$\theta_{32a}'$, respectively, and beamwidth B'. Beam ports $20_{1c}'$–$20_{32c}'$ of lens 16c' are offset counterclockwise along surface 21c' by such one-third spacing (i.e. $+0.0456/3$) in sin $\theta$ space with respect to the positions of beam ports $20_{1b}'$–$20_{32b}'$ to form, with antenna elements $12_{71}'$–$12_{105}'$ of subarray 14c', 32 beams $420_{1c}'$–$420_{32c}'$ of width B' with angular deviations $\theta_{1c}'$–$\theta_{32c}'$, respectively, from boresight axis 60'. Thus, it is seen that lenses 16a', 16b', 16c' (along with subarrays 14a', 14b', 14c') form three sets of interleaved beams $420_{1a}'$, $420_{1b}'$, $420_{1c}'$–$420_{32a}'$, $420_{32b}'$, $420_{32c}'$–that is, three sets of 32 beams having pointing directions skewed from one another by $\frac{1}{3}$ beam width (B'/3).

Array 14' spatially combines the B'-width beams formed by individual lenses 16a'–16c' and subarrays 14a'–14c', respectively, (i.e., three adjacent ones of interleaved beams $420_{1a}'$, $420_{1b}'$, $420_{1c}'$–$420_{32a}'$, $420_{32b}'$, $420_{32c}'$) into a composite beam having a width of B'/3, since the aperture of array 14' is three times larger than that of each subarray 14a'–14c'. In operation, switches 26a', 26b', 26c', which are SP32T switches, are initially set at poisitions $40_{1a}'$, $40_{1b}'$, $40_{1c}'$ thereof, respectively. Such switches are serially incremented, beginning with switch 26c', until they are set to positions $40_{32a}'$, $40_{32b}'$, $40_{32c}'$, respectively. That is, switch 26c' is incremented to position $40_{2c}'$, then switch 26b' incremented to position $40_{2b}'$, then switch 26a' the position $40_{2a}'$, and so on. Thus, array antenna system 10' scans a composite beam from an angle (with respect to boresight axis 60') determined by beam pointing directions $\theta_{1a}'$, $\theta_{2a}'$, $\theta_{3a}'$ across the coverage sector of array 14' to an angle determined by beam pointing directions $\theta_{32a}'$, $\theta_{32b}'$, $\theta_{32c}'$. Since switches 26a'–26c' have 32 positions and are incremented alternately, a little thought reveals that 94 composite beams $520_1'$–$520_{94}'$ having respective angular deviations $\theta_1'$–$\theta_{94}'$ from boresight axes 60' are formed.

Figure 5B:
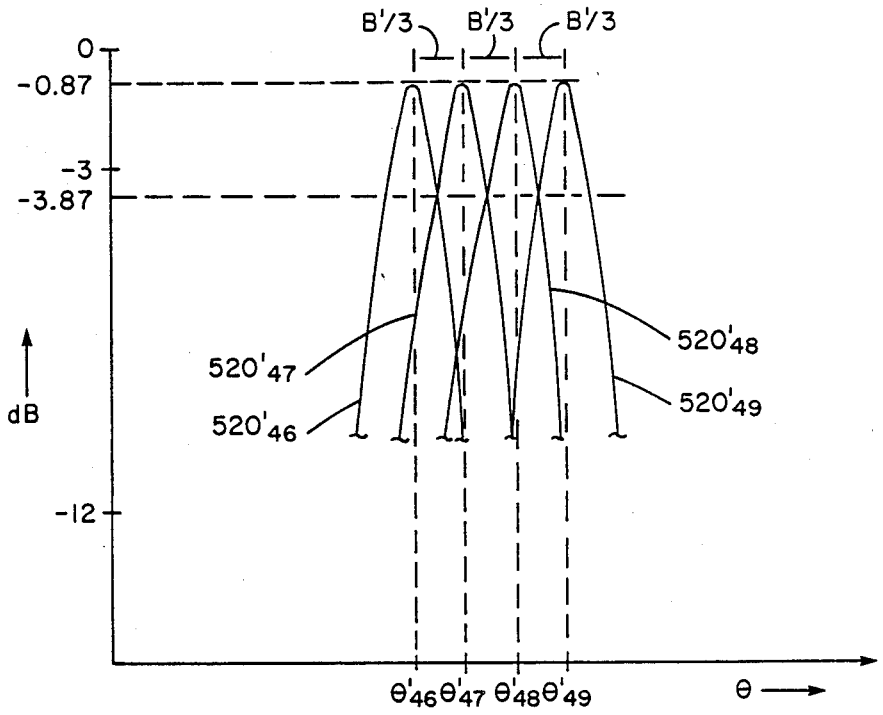
FIGS. 5A and 5B are beam patterns produced by the array antenna system of FIG. 4.
Figure 5A:
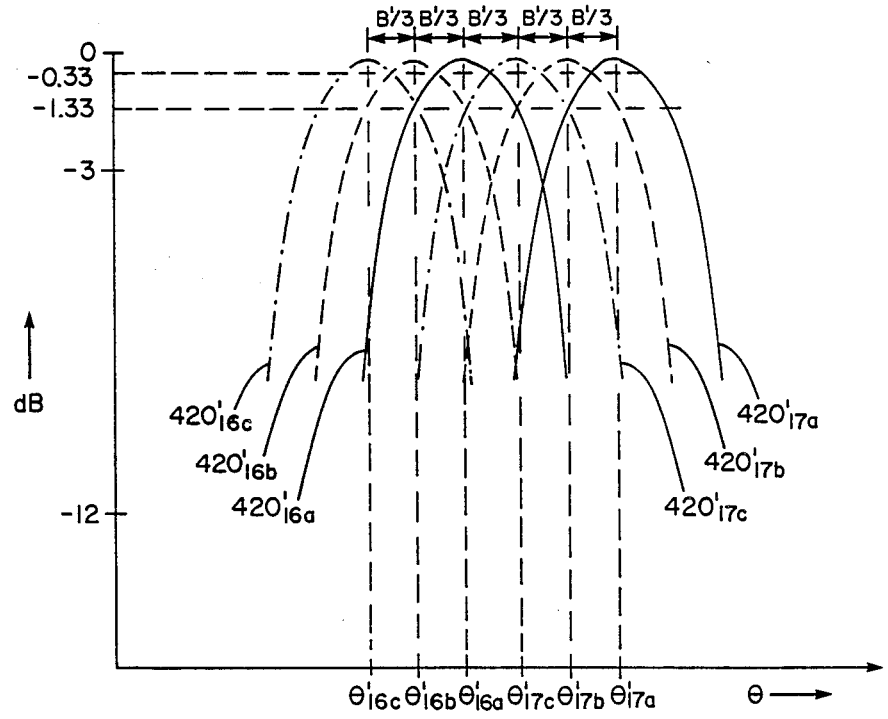

FIG. 5A illustrates the one-third-beamwidth-skewed beams formed individually by lenses 16a'–16c' and subarrays 14a'–14c' in response to RF energy switchably applied to beam ports $20_{16a}'$–$20_{17a}'$, $20_{16b}'$–$20_{17b}'$, $20_{16c}'$–$20_{17c}'$, respectively, in the manner described above. Thus, lens 16b' and subarray 14b' form beams $420_{16b}'$, $420_{17b}'$ corresponding to beam ports $20_{16b}'$, $20_{17b}'$, respectively, such beams $420_{16b}'$, $420_{17b}'$ having a 3dB width of B' and having peaks with angular deviations $\theta_{16b}'$, $\theta_{17b}'$ from boresight. In response to energy applied to beam ports $20_{16a}'$–$20_{17a}'$, lens 16a' and subarray 14a' form beams $420_{16a}'$, $420_{17a}'$, respectively, (FIG. 5A) having peaks shifted to the right of the peaks of beams $420_{16b}'$, $420_{17b}'$ by $\frac{1}{3}$ of the beamwidth thereof (i.e., B'/3). Conversely, in response to energy applied to beam ports $20_{16c}'$, $20_{17c}'$, lens 16c' and subarray 14c' form B' wide beams $420_{16c}'$, $420_{17c}'$ having peaks shifted to the left of the peaks of corresponding beams $420_{16b}'$, $420_{17b}'$ by B'/3. It is noted that since adjacent ones of beams $420_{16c}'$, $420_{16b}'$, $420_{16a}'$, $420_{17c}'$, $420_{17b}'$, $420_{17a}'$ are separated by $\frac{1}{3}$ of the beamwidth thereof, such beams have crossovers at an angular distance $\theta_c$ of 1/6 beamwidth from the peaks thereof. Thus, from equation (3) it is seen that adjacent, $\frac{1}{3}$-beamwidth-skewed beams have high-frequency crossovers at $-0.33$dB with respect to the levels of the peaks thereof.

FIG. 5B illustrates the four composite beams $520_{46}'$–$520_{49}'$ formed by array 14' of antenna elements $12_1'$–$12_{105}'$ by spatially combining corresponding B'-width beams from lenses 16a', 16b', 16c'. Thus, beams $420_{16c}'$, $420_{16b}'$, $420_{16a}'$ are combined to form composite beam $520_{46}'$ having a width of B'/3 and a beam pointing direction $\theta_{46}'$ intermediate the pointing angles $\theta_{16a}'$, $\theta_{16b}'$, $\theta_{16c}'$ of beams $420_{16a}'$, $420_{16b}'$, $420_{16c}'$. A little thought reveals that such angle $\theta_{46}'$ is the same as angle $\theta_{16b}'$. Likewise, when switch 26c' is incremented to position $40_{17c}'$, composite beam $520_{47}'$ results having an angle $\theta_{47}'$ determined by beams $420_{16b}'$ ($\theta_{16b}'$), $420_{16a}'$ ($\theta_{16a}'$) and newly-formed beam $420_{17c}'$ ($\theta_{17c}'$), such angle $\theta_{47}'$ being seen to be the same as angle $\theta_{16a}'$ of beam $420_{16a}'$. When controller 30' next increments switch 26b' to position $40_{17b}'$, composite beam $520_{48}'$ is formed having a direction $\theta_{48}'$ (equal to $\theta_{17c}'$) intermediate the directions $\theta_{16a}'$, $\theta_{17c}'$, $\theta_{17b}'$ of respective beams $420_{16a}'$, $420_{17c}'$ and newly-formed beam $420_{17b}'$. Switch 26a' is then incremented to position $40_{17a}'$, forming a new composite beam $520_{49}'$ at an angle $\theta_{49}'$ intermediate the angles of beams $420_{17c}'$ ($\theta_{17c}'$), $420_{17b}'$ ($\theta_{17b}'$), $420_{17a}'$ ($\theta_{17a}'$), that is, at an angle $\theta_{49}'$ equal to angle $\theta_{17b}'$.

Each one of the 94 composite beams $520_1'$–$520_{94}'$ (for example, beams $520_{46}'$–$520_{49}'$ shown in FIG. 5B) has a beamwidth of B'/3 and the peaks of such beams are separated by B'/3. Comparing FIGS. 5A, 5B, it is seen that at the pointing angle of a given composite beam (for example, beam $520_{46}'$ with a pointing angle $\theta_{46}'$) the levels of the three beams which are combined to produce such composite beam $520_{46}'$ (i.e., beams $420_{16c}'$, $420_{16b}'$, $420_{16a}'$) are $-1.33$dB, 0dB and $-1.33$dB, respectively. That is, of such three constituent beams, the intermediate beam is at 0dB and the other two beams cross each other down 1.33dB (see equation (3), with $\theta_c = B'/3$). Thus, the relative gain of each composite beam $520_1'$–$520_{94}'$ at the peak point thereof is:

$$\begin{aligned} \text{Gain} &= 20 \log \frac{1}{\sqrt{3}} \left[10^{\frac{-1.33}{20}} + 1 + 10^{\frac{-1.33}{20}}\right] \text{dB} \\ &= +3.90 \text{ dB} \end{aligned} \tag{7}$$

It is noted that if the three constituent beams forming each composite beam were pointed at the same angle rather than skewed by B'/3, (i.e., if such beams were overlaying) the gain of each composite beam would be +4.77dB (20 log [3/$\sqrt{3}$]), thus indicating that the composite beams $520_1'$–$529_{94}'$ experience a 0.87dB combining loss, as shown in FIG. 5B. However, at high frequency, adjacent composite beams (such as beams $520_{46}'$, $520_{47}'$), which are spaced by B'/3, cross over at B'/6 from the peaks thereof. Thus, from equation (3), with $\theta_c$=B'/6, it is seen that composite beams $520_1'$–$520_{94}'$ have high frequency crossovers which are down 3dB from the peaks thereof. Taking the aforementioned +4.77dB gain as a 0dB reference, the high frequency crossovers between composite beams $520_1'$–$520_{94}'$ are actually 3.87dB down with respect thereto.

The present invention may be extended to apply to antenna systems where more than three radio frequency lenses are utilized. As discussed, in the general case, corresponding beam ports on a plurality of M modular lenses will be skewed from each other by the nominal beam port spacing (S) in sin $\theta$ space (here, 0.0456) multiplied by the reciprocal of the number, M, of modular lenses used, that is, skew=S/M. Thus, the beams formed by such lenses (and associated subarrays) from the corresponding beam ports thereof will be "skewed" or spaced (in beamwidths) by the reciprocal of the number of lenses used.

Having described preferred embodiments of the present invention, other embodiments may become apparent to those skilled in the art. For instance, as discussed, although a transmitting system has been described, the invention applies equally to receiving systems by the principles of reciprocity. It is felt, therefore, that the scope of the present invention should be limited only by the spirit and scope of the appended claims.

What is claimed is:

1. In combination:

(a) an array antenna comprising a plurality of antenna elements;

(b) a plurality of electromagnetic lenses, each one of the plurality of lenses comprising a set of array ports coupled to corresponding ones of the plurality of antenna elements;

(c) each one of the plurality of lenses further comprising a set of beam ports successively disposed along an arc wherein:

(i) each successive beam port on each lens corresponds to a successive beamport on each of the others of the plurality of lenses;

(ii) each beam port has an angle associated therewith said angle being the angle between the axis of symmetry of the arc on which said beam port is disposed and the line between said beam port and the center of curvature of said arc; and (iii) for each pair of consecutive beam ports on each arc, one beam port on each of the other of the plurality of arcs has an angle associated therewith having a value between the values of the angles associated with the beam ports of the pair; and (d) means for coupling the same radio frequency energy signal to a selected beam port on each of the plurality of electromagnetic lenses.

2. The combination of claim 1 wherein the means for coupling the same radio frequency energy signal to a selected beam port of each one of the plurality of electromagnetic lenses couples the same radio frequency energy signal to one beam port on one lens and to the corresponding beam port or a beam port adjacent to the corresponding beam port on each of the other lenses.

3. A radio frequency antenna system comprising:

(a) array antenna means comprising a plurality of antenna elements;

(b) a plurality of electromagnetic lenses, each one of said plurality of lenses comprising a set of array ports coupled to corresponding ones of the plurality of antenna elements;

(c) each one of the plurality of electromagnetic lenses further comprising a set of beam ports positioned such that:

(i) radio frequency energy signals coupled to each beam port produce a beam projected in a different direction; and (ii) for every pair of adjacent beam directions on each lens, there is a beam direction on each of the others of the plurality of lenses intermediate the pair of directions; and (d) means for coupling the same radio frequency energy signal to a selected beam port on each of the plurality of lenses.

4. The radio frequency antenna system of claim 3 wherein the beams of radio frequency energy produced by each of the lenses has a planar wavefront associated therewith, and further comprising:

means for producing substantial phase alignment between the planar wavefronts of the beams produced by each lens.

5. The radio frequency antenna system of claim 4 wherein said phase alignment producing means comprises a plurality of signal paths coupled between a radio frequency signal producing means and the corresponding beam ports which form a plurality of beams of radio frequency energy, said plurality of signal paths having relative electrical lengths selected to produce said substantial phase alignment.

6. A radio frequency antenna system comprising:

(a) antenna means comprising a plurality of antenna elements arranged in an array, said array comprising a pair of subarrays of antenna elements;

(b) a pair of electromagnetic lenses, each one of said pair of lenses comprising a plurality of array ports, the plurality of array ports of a first one of the pair of lenses being coupled to the antenna elements of a first one of the pair of subarrays, and the plurality of array ports of a second one of the pair of lenses being coupled to the antenna elements of a second one of the pair of subarrays; and (c) the first one of the pair of lenses further comprising a first set of beam ports, each such beam port disposed along an arc with a predetermined angle between the axis of symmetry of the arc and the line between the center of curvature of the arc and the beam port, and the second one of the pair of lenses further comprising a second set of beam ports, each such beam port disposed along an arc with a predetermined angle between the axis of symmetry of the arc and the line between the center of curvature of the arc and the beamport, the first and second sets of beam ports being arranged such that the predetermined angle for each beam port on the second of the pair of lenses is between the angles for two adjacent beam ports on the first lens; and (d) means for coupling the same radio frequency signal to a selected beam port in the first set and a selected beam port in the second set.

7. The radio frequency antenna system of claim 6 wherein:

(a) the subarrays of antenna elements are arranged to provide a first beam in response to the signal coupled to the selected beam port in the first set and a second beam in response to the signal coupled to the selected beam port in the second set, each such beam having a predetermined beamwidth, B; and (b) the first beam and second beam combine to form a composite beam with a beamwidth of substantially B/2.

8. The radio frequency antenna system of claim 7 wherein the:

means for producing a radio frequency signal; and means for coupling the same radio frequency signal to selected ones of the first and second sets of beam ports comprises a switch responsive to a control signal.

9. The radio frequency antenna system of claim 8 wherein the first beam and second beam of radio frequency energy have planar wavefronts associated therewith, and further comprising:

means for producing substantial phase alignment between the planar wavefronts of the first and second beams.

10. The radio frequency antenna system of claim 9 wherein said phase alignment producing means comprises a first set of signal paths coupled between a radio frequency signal producing means and the first set of beam ports and a second set of signal paths coupled between the radio frequency signal producing means and the second set of beam ports, corresponding signal paths of the first and second sets of signal paths coupled to corresponding beam ports of the first and second sets of beam ports having relative electrical lengths selected to produce said substantial phase alignment.

11. The radio frequency antenna system of claim 10 wherein:

(a) the beam ports in the first set are disposed successively along a first arc and the beam ports of the second set are disposed successively along a second arc, each of the successive beam ports in the first set corresponding to a successive beam port in the second set; and (b) each subarray has a length D and a first beam port of the first set of beam ports is arranged to form a beam of radio frequency energy at a predetermined angle, $\phi$, with respect to a boresight of the array, the signal path coupled to said first beam port of the first set of beam ports having a nominal electrical length, the signal path coupled to the corresponding beam port of the second set of beam ports having an electrical length, $\Delta L$, with respect to the nominal length, of substantially D sin $\phi$.

12. In combination:

(a) antenna means comprising a plurality of antenna elements disposed in an array, such array comprising a pair of subarrays of antenna elements;

(b) a pair of radio frequency lenses, each one of the pair of lenses comprising a plurality of array ports, the array ports of a first one of the pair of lenses being coupled to the antenna elements of a first one of the pair of subarrays, and the array ports of a second one of the pair of lenses being coupled to the antenna elements of a second one of the pair of subarrays;

(c) the first one of the pair of radio frequency lenses having a first axis of symmetry and further comprising a first set of N beam ports successively disposed along an arc of best focus of said first lens with the angles between the first axis of symmetry and the line from the center curvature of the arc to each successive beam port designated $\theta_1, \theta_2 \ldots \theta_N$;

(d) the second one of the pair of radio frequency lenses having a second axis of symmetry and further comprising a second set of N beam ports successively disposed along an arc of best focus of said second lens with the successive beam port in the second set corresponding to the successive beam ports in the first set and with the angles between the first axis of symmetry and the line from the center of curvature of the arc to each successive beam port designated $\theta_1', \theta_2' \ldots \theta_N'$;

(e) means for coupling the same radio frequency energy signal to a selected one of the first set of beam ports and a selected one of the second set of beam ports in accordance with a control signal;

(f) corresponding beam ports of the first and second sets of beam ports being arranged at first and second, different positions with respect to the first and second axes of symmetry such that each angle in the set $\theta_1', \theta_2' \ldots \theta_N'$ is less than the corresponding angle in the set $\theta_1, \theta_2 \ldots \theta_N$ and greater than the angle preceding the corresponding angle in the set $\theta_1, \theta_2 \ldots \theta_N$; and (g) wherein the signal coupled to the selected beam ports produces a pair of beams, and said antenna means combines said pair of beams to form a composite beam having a direction intermediate the directions of the pair of beams.

13. The combination of claim 12 wherein each one of the pair of beams of radio frequency energy has a planar wavefront associated therewith, said radio frequency energy signal coupling means comprising means for producing substantantial phase alignment between the planar wavefronts of the pair of beams.

14. The combination of claim 13 wherein said phase alignment producing means comprises a first set of signal paths coupled between a source of radio frequency energy and the first set of beam ports and a second set of signal paths coupled between the source of radio frequency energy and the second set of beam ports, corresponding signal paths of the first and second sets of signal paths coupled to corresponding beam ports of the first and second sets of beam ports having relative electrical lengths selected to produce said substantial phase alignment.

15. The combination of claim 14 wherein each subarray has a length D and a first beam port of the first set of beam ports is arranged to form a beam of radio frequency energy at a predetermined angle, $\phi$, with respect to a boresight of the array, the signal path coupled to said first beam port of the first set of beam ports having a nominal electrical length, the signal path coupled to the corresponding beam port of the second set of beam ports having an electrical length, $\Delta L$, with respect to the nominal length, of substantially D sin $\phi$.

* * * * *